US007086374B2

(12) United States Patent
McDonald et al.

(10) Patent No.: US 7,086,374 B2
(45) Date of Patent: Aug. 8, 2006

(54) PWM CONTROL OF A LIFTER OIL MANIFOLD ASSEMBLY SOLENOID

(75) Inventors: Mike M. McDonald, Macomb, MI (US); William C. Albertson, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 147 days.

(21) Appl. No.: 10/851,034

(22) Filed: May 21, 2004

(65) Prior Publication Data

US 2005/0257768 A1 Nov. 24, 2005

(51) Int. Cl.
*F02B 77/00* (2006.01)

(52) U.S. Cl. ..... 123/198 F; 123/90.15

(58) Field of Classification Search ..... 123/198 F, 123/90.15, 90.16, 90.17
See application file for complete search history.

(56) References Cited

U.S. PATENT DOCUMENTS 4,227,505 A * 10/1980 Larson et al. ..... 123/198 F
6,688,275 B1 * 2/2004 Shindou et al. ..... 123/198 F

* cited by examiner

*Primary Examiner*—Tony M. Argenbright
*Assistant Examiner*—Katrina Harris
(74) *Attorney, Agent, or Firm*—Christopher DeVries

(57) ABSTRACT

A solenoid driver generates a current signal to drive a solenoid of a lifter oil manifold assembly (LOMA) to switch a displacement on demand engine between activated and deactivated modes. The solenoid driver includes a current module that generates the current signal based on a duty cycle signal and a switching module that regulates the duty cycle signal based on the activated and deactivated modes. The duty cycle signal is 100% for a first period after the engine switches to the deactivated mode and is variable for a second period after the first period.

30 Claims, 5 Drawing Sheets

PWM CONTROL OF A LIFTER OIL MANIFOLD ASSEMBLY SOLENOID

FIELD OF THE INVENTION

The present invention relates to internal combustion engines, and more particularly to engine control systems that control engine operation in a displacement on demand engine.

BACKGROUND OF THE INVENTION

Some internal combustion engines include engine control systems that deactivate cylinders under specific low load operating conditions. For example, an eight cylinder engine can be operated using four cylinders to improve fuel economy by reducing pumping losses. This process is generally referred to as displacement on demand or DOD. Operation using all of the engine cylinders is referred to as an activated mode. A deactivated mode refers to operation using less than all of the cylinders of the engine (one or more cylinders not active).

In the deactivated mode, there are fewer firing cylinders. As a result, there is less drive torque available to drive the vehicle driveline and accessories (e.g., alternator, coolant pump, A/C compressor). Engine efficiency, however, is increased as a result of decreased air pumping losses due to the deactivated cylinders not taking in and compressing fresh intake air.

A lifter oil manifold assembly (LOMA) is implemented to activate and deactivate select cylinders of the engine. The LOMA includes a series of lifters and solenoids associated with corresponding cylinders. The solenoids are selectively energized to enable hydraulic fluid flow to the lifters to inhibit valve lifter operation, thereby deactivating the corresponding cylinders. The solenoids remain energized while the engine operates in the deactivated mode. As a result, electrical current to the solenoids must be maintained throughout operation in the deactivated mode. The current supply to the solenoids during the deactivated mode increases the vehicle's current requirements and solenoid operating temperatures.

SUMMARY OF THE INVENTION

Accordingly, the present invention provides a solenoid driver that generates a current signal to drive a solenoid of a lifter oil manifold assembly (LOMA) to switch between activated and deactivated modes in a displacement on demand engine. The solenoid driver includes a current module that generates the current signal based on a duty cycle signal and a switching module that regulates the duty cycle signal based on the activated and deactivated modes. The duty cycle signal is 100% for a first period after the engine switches to the deactivated mode and is variable for a second period after the first period.

In one feature, the variable duty cycle is determined based on operating parameters of said LOMA. The operating parameters include an available voltage and a hydraulic fluid pressure. The variable duty cycle is determined from a look-up table based on the operating parameters.

In another feature, the solenoid driver further includes a duty cycle module that generates the variable duty cycle based on an available voltage and a hydraulic fluid pressure associated with the LOMA. The solenoid driver also includes a voltage module that determines the available voltage based on a voltage signal and a pressure module that determines the hydraulic fluid pressure based on a pressure signal. The duty cycle module includes a look-up table, wherein the variable duty cycle is determined from the look-up table based on the available voltage and the hydraulic fluid pressure.

In another feature, the duty cycle signal is 0% when the engine is operating in the activated mode.

In another feature, the current module includes a switch that is regulated based on the duty cycle signal.

In still another feature, the current signal is a pulse-width modulated (PWM) current signal.

In yet another feature, the solenoid driver further includes a diode that communicates with an output of the current module. The diode enables a continuous flow of current through the solenoid.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
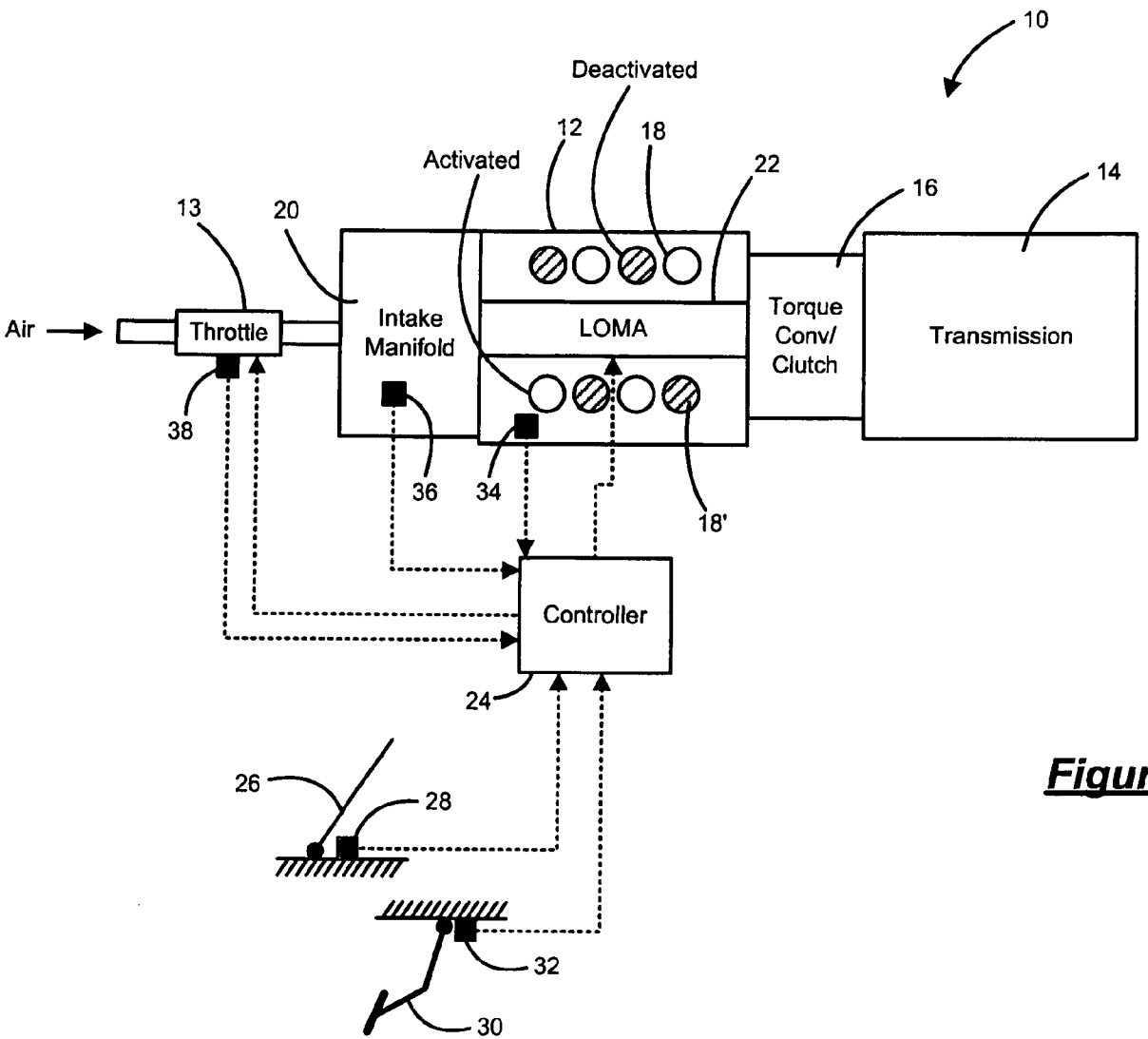
FIG. 1 is a functional block diagram illustrating a vehicle powertrain including a displacement on demand (DOD) engine control system according to the present invention.

The following description of the preferred embodiment is merely exemplary in nature and is in no way intended to limit the invention, its application, or uses. For purposes of clarity, the same reference numbers will be used in the drawings to identify similar elements. As used herein, activated refers to operation using all of the engine cylinders. Deactivated refers to operation using less than all of the cylinders of the engine (one or more cylinders not active). As used herein, the term module refers to an application specific integrated circuit (ASIC), an electronic circuit, a processor (shared, dedicated, or group) and memory that executes one or more software or firmware programs, a combinational logic circuit, or other suitable components that provide the described functionality.

Referring now to FIG. 1, a vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13. The engine 12 includes N cylinders 18. One or more select cylinders 18' are selectively deactivated during engine operation. Although FIG. 1 depicts eight cylinders (N=8), it is appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18. The engine also includes a lifter oil manifold assembly (LOMA) 22 that deactivates the select cylinders 18', as described in further detail below.

A controller 24 communicates with the engine 12 and various inputs and sensors as discussed herein. A vehicle operator manipulates an accelerator pedal 26 to regulate the throttle 13. More particularly, a pedal position sensor 28 generates a pedal position signal that is communicated to the controller 24. The controller 24 generates a throttle control signal based on the pedal position signal. A throttle actuator (not shown) adjusts the throttle 13 based on the throttle control signal to regulate air flow into the engine 12.

The vehicle operator manipulates a brake pedal 30 to regulate vehicle braking. More particularly, a brake position sensor 32 generates a brake pedal position signal that is communicated to the controller 24. The controller 24 generates a brake control signal based on the brake pedal position signal. A brake system (not shown) adjusts vehicle braking based on the brake control signal to regulate vehicle speed. An engine speed sensor 34 generates a signal based on engine speed. An intake manifold absolute pressure (MAP) sensor 36 generates a signal based on a pressure of the intake manifold 20. A throttle position sensor (TPS) 38 generates a signal based on throttle position.

When the engine 12 enters an operating point to enable the deactivated mode, the controller 24 transitions the engine 12 to the deactivated mode. In an exemplary embodiment, N/2 cylinders 18 are deactivated, although one or more cylinders may be deactivated. Upon deactivation of the select cylinders 18', the controller 24 increases the power output of the remaining or activated cylinders 18. The inlet and exhaust ports (not shown) of the deactivated cylinders 18' are closed to reduce pumping losses.

The engine load is determined based on the intake MAP, cylinder mode and engine speed. More particularly, if the MAP is below a threshold level for a given RPM, the engine load is deemed light and the engine 12 could possibly be operated in the deactivated mode. If the MAP is above the threshold level for the given RPM, the engine load is deemed heavy and the engine 12 is operated in the activated mode. The controller 24 controls the LOMA 22 based on the solenoid control, as discussed in further detail below.

Figure 2:
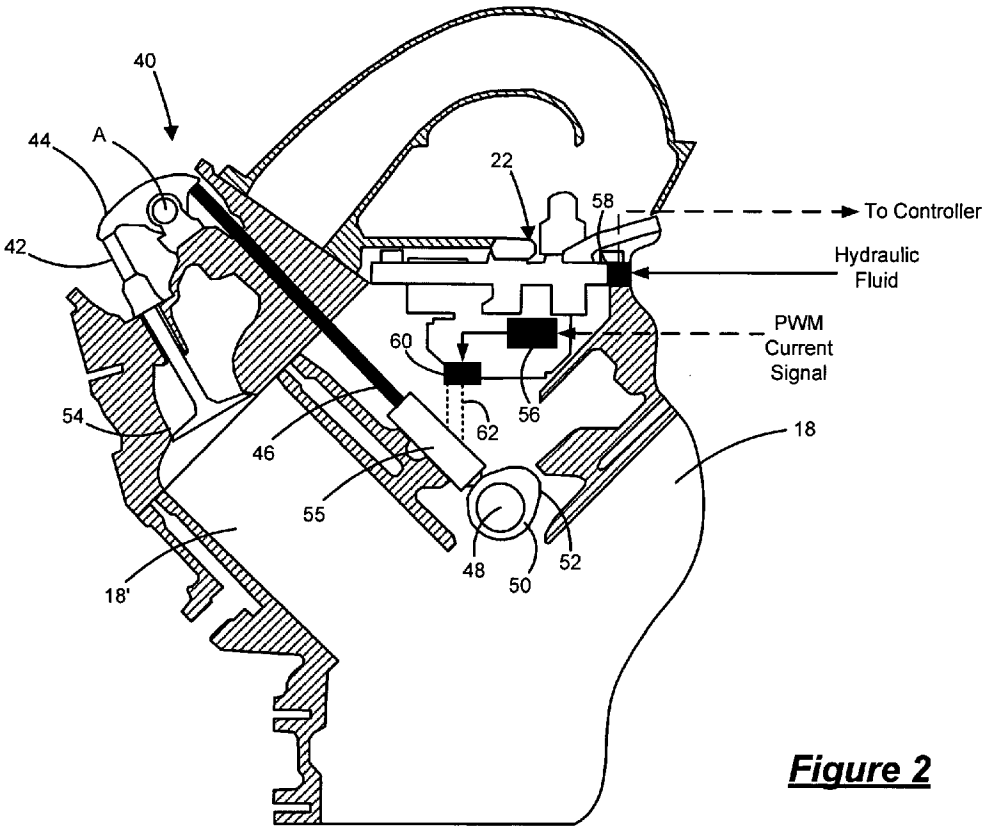
FIG. 2 is a partial cross-sectional view of the DOD engine illustrating a lifter oil manifold assembly (LOMA) and an intake valvetrain.

Referring now to FIG. 2, an intake valvetrain 40 of the engine 12 includes an intake valve 42, a rocker 44 and a pushrod 46 associated with each cylinder 18. The engine 12 includes a rotatably driven camshaft 48 having a plurality of valve cams 50 disposed therealong. A cam surface 52 of the valve cams 50 engage the pushrods 46 to cyclically open and close intake ports 54 within which the intake valves 42 are positioned. The intake valve 42 is biased to a closed position by a biasing member (not illustrated) such as a spring. As a result, the biasing force is transferred through the rocker 44 to the pushrod 46, causing the pushrod 46 to press against the cam surface 52.

As the camshaft 48 is caused to rotate, the valve cam 50 induces linear motion of the corresponding pushrod 46. As the pushrod 46 is induced to move outward, the rocker 44 is caused to pivot about an axis (A). Pivoting of the rocker 44 induces movement of the intake valve 42 toward an open position, thereby opening the intake port 54. The biasing force induces the intake valve 42 to the closed position as the camshaft 48 continues to rotate. In this manner, the intake port 54 is cyclically opened to enable air intake.

Although the intake valvetrain 40 of the engine 12 is illustrated in FIG. 2, it is appreciated that the engine 12 also includes an exhaust valvetrain (not shown) that operates in a similar manner. More specifically, the exhaust valvetrain includes an exhaust valve, a rocker and a pushrod associated with each cylinder 18. Rotation of the camshaft 48 induces reciprocal motion of the exhaust valves to open and close associated exhaust ports, as similarly described above for the intake valvetrain.

The LOMA 22 provides pressurized fluid to a plurality of lifters 55 and includes solenoids 56 (shown schematically) associated with select cylinders 18' (see FIG. 1). The select cylinders 18' are those that are deactivated when operating the engine 12 in the deactivated mode. The lifters 55 are disposed within the intake and exhaust valvetrains to provide an interface between the cams 50 and the pushrods 46. In general, there are two lifters 55 provided for each select cylinder 18' (one lifter for the intake valve 42 and one lifter for the exhaust valve). It is anticipated, however, that more lifters 55 can be associated with each select cylinder 18' (i.e., multiple inlet or exhaust valves per cylinder 18'). The LOMA 22 further requires a pressure sensor 58 that generates a pressure signal indicating a pressure of a hydraulic fluid supply to the LOMA 22. It is anticipated that one or more pressure sensors 22 can be implemented.

Each lifter 55 is hydraulically actuated between first and second modes. The first and second modes respectively correspond to the activated and deactivated modes. In the first mode, the lifter 55 provides a mechanical connection between the cam 50 and the pushrod 46. In this manner, the cam 50 induces linear motion of the lifter 55, which is transferred to the pushrod 46. In the second mode, the lifter 55 functions as a buffer to provide a mechanical disconnect between the cam 50 and the pushrod 46. Although the cam 50 induces linear motion of the lifter 55, the linear motion is not transferred to the pushrod 46. A more detailed description of the lifters 55 is presently foregone as lifters and their operation are known to those of skill in the art.

The solenoids 56 selectively enable hydraulic fluid flow to the lifters 55 to switch the lifters 55 between the first and second modes. Although there is generally one solenoid 56 associated with each select cylinder 18' (i.e., one solenoid for two lifters), it is anticipated that more or fewer solenoids 56 can be implemented. Each solenoid 56 actuates an associated valve 60 (shown schematically) between open and closed positions. In the closed position, the valve 60 inhibits pressurized hydraulic fluid flow to the corresponding lifters 55. In the open position, the valve 60 enables pressurized fluid flow to the corresponding lifters 55 via a fluid passage 62. The pressurized hydraulic fluid flow is provided to the LOMA 22 from a pressurized hydraulic fluid source.

Although not illustrated, a brief description of an exemplary solenoid is provided herein to provide a better understanding of the present invention. The solenoids 56 generally include an electromagnetic coil and a plunger that is disposed coaxially within the coil. The plunger provides a mechanical interface between the solenoid 56 and a mechanical element, such as the valve 60. The plunger is biased to a first position relative to the coil by a biasing force. The biasing force can be imparted by a biasing member, such as a spring, or by a pressurized fluid. The solenoid 56 is energized by supplying current to the coil, which induces magnetic force along the coil axis. The magnetic force induces linear movement of the plunger to a second position. In the first position, the plunger holds the valve 60 in its closed position to inhibit pressurized hydraulic fluid flow to the corresponding lifters. In the second position, the plunger actuates the valve 60 to its open position to enable pressurized hydraulic fluid flow to the corresponding lifters.

Initially, the solenoid 56 must produce a higher magnetic field to overcome the relatively wide armature to pole gap to move from the first position corresponding to the valve closed position. Once moved, less magnetic force is required to maintain the plunger and valve 60 in the second position corresponding to the valve open position. For example since a solenoid's magnetic force is somewhat proportional to its electrical current, and in versly proportional to armature air-gap an exemplary solenoid may require 498 mA of electrical current to move the plunger to the second position. Only 127 mA of electrical current, however, may be required to hold the plunger in the second position.

The solenoid control of the present invention controls the solenoid 56 based on a pulse-width modulated (PWM) current signal. The PWM current signal is generated based on a duty cycle signal that ranges between 0% and 100%. At 0%, no current is supplied to the solenoid and at 100%, full current is supplied to the solenoid. The solenoid control provides a 0% duty cycle when the engine 12 is operating in the activated mode. A 100% duty cycle is provided for a threshold time when the engine 12 initially transitions to the deactivated mode. The 100% duty cycle enables full current supply to the solenoid 56 to enable the plunger to overcome opposing forces and actuate the valve 60 to the open position. The threshold time indicates the time required for the plunger to move to the second position. The threshold time is based on solenoid type, and is generally characterized by the solenoid valve manufacturer.

Once the threshold time has expired, a variable duty cycle is provided and can range between greater than 0% and less than 100%, while the engine 12 is operating in the deactivated mode. Less than a 100% duty cycle is sufficient to maintain the plunger and the valve 60 in the second and open positions, respectively. However, greater than a 0% duty cycle is required to maintain deactivation of the select cylinders 18'. The variable duty cycle is based on LOMA operating parameters including hydraulic fluid pressure ($P_{HYD}$), and a supply voltage ($V_{SUPPLY}$). The supply voltage is the voltage from the battery system that is available to drive the components of the LOMA 22. It is anticipated, however, that other operating parameters can be used to determine the variable duty cycle.

Figure 3:
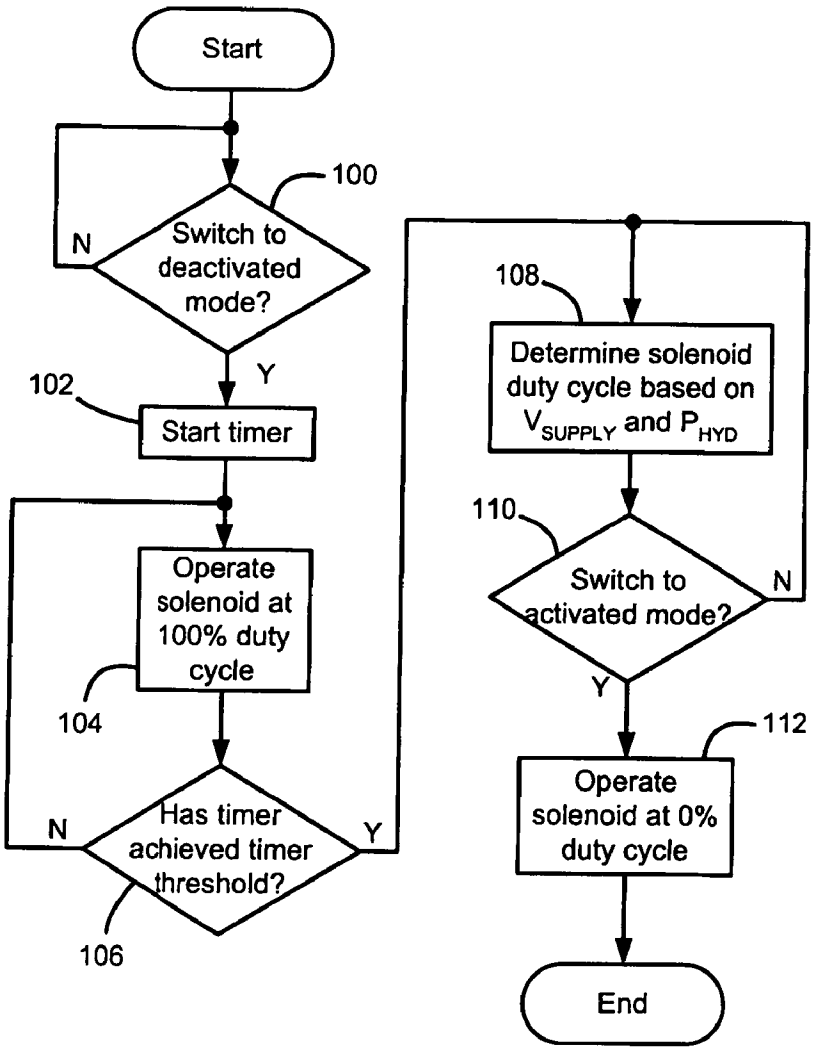
FIG. 3 is a flowchart illustrating the solenoid control of the present invention.

Referring now to FIG. 3, the solenoid control will be described in further detail. In step 100, control determines whether engine operation switches to the deactivated mode. If the engine operation does not switch, control loops back. If the engine operation does switch to the deactivated mode, control sets a timer in step 102. In step 104, control operates the solenoid 56 at 100% duty cycle. In step 106, control determines whether the timer has achieved the timer threshold. If the timer has not achieved the timer threshold, control loops back to step 104. If the timer has achieved the timer threshold, control continues in step 108.

Control determines the duty cycle based on $V_{SUPPLY}$ and $P_{HYD}$ in step 108. In step 110, control determines whether engine operation switches to the activated mode. If the engine operation does not switch, control loops back to step 108. If the engine operation does switch to the activated mode, control operates the solenoid 56 at 0% duty cycle in step 112 and control ends.

Figure 4:
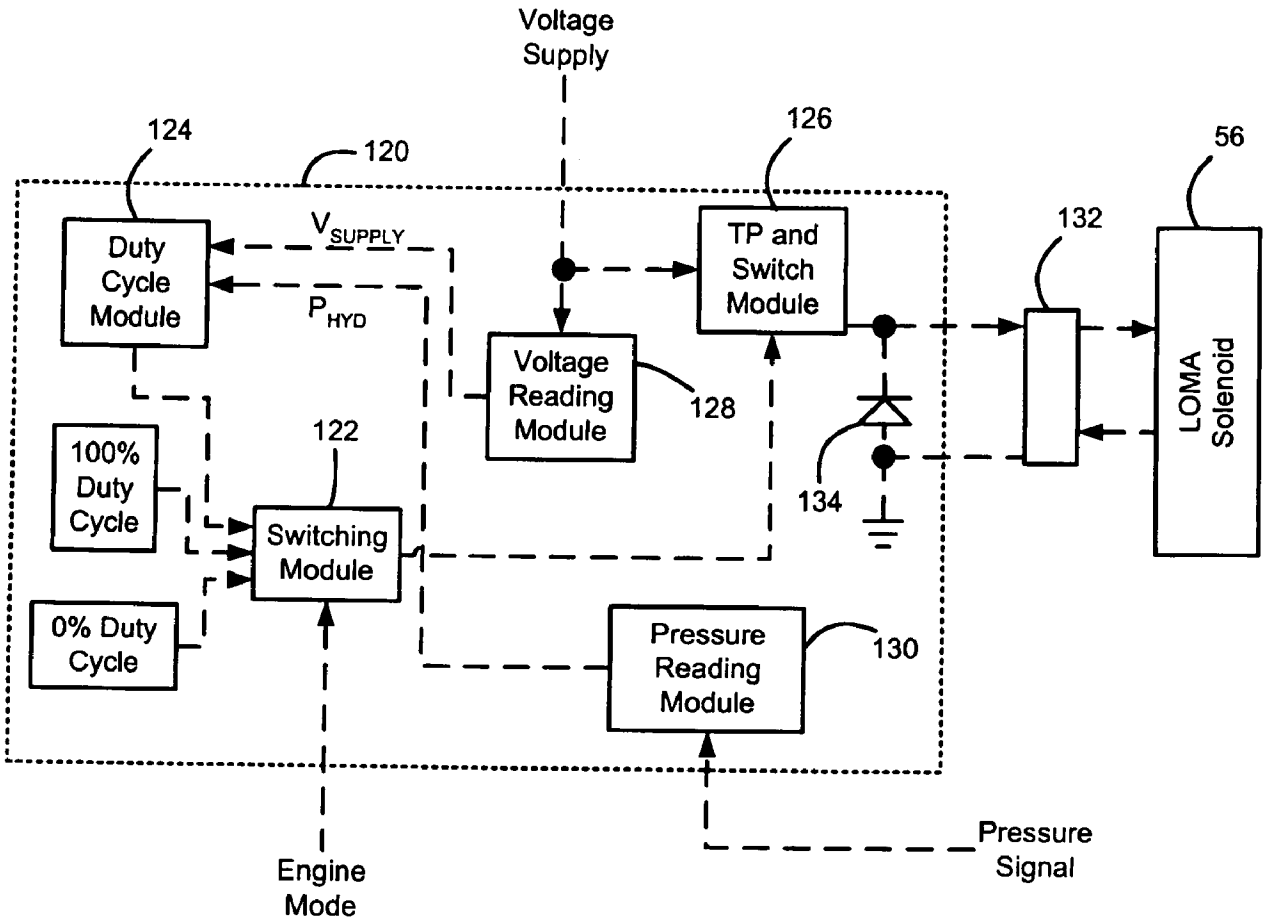
FIG. 4 is a block diagram schematically illustrating a solenoid driver that executes the solenoid control of the present invention.

Referring now to FIG. 4, a block diagram schematically illustrates a solenoid driver 120 that includes modules which execute the solenoid control of the present invention. The modules include a switching module 122, a duty cycle module 124, a timer processor (TP) and switch module 126, a voltage reading module 128 and a pressure reading module 130. Inputs to the switching module 122 include the variable duty cycle signal generated by the duty cycle module 124, the 100% duty cycle signal and the 0% duty cycle signal. The switching module 122 forwards one of these three inputs to the TP and switch module 126 based on an engine mode signal and a timer (not shown). The engine mode signal indicates whether the engine 12 is to operate in the activated mode or the deactivated mode and the timer sets the time required for the plunger to move from the first position to the second position.

The TP and switch module 126 enables current flow to the solenoid at the commanded duty cycle. The current flow is provided via the supply voltage. The TP and switch module 126 converts the duty cycle signal into a pulse-train that modulates the switch between open and closed states. In this manner, current is supplied to the solenoid 56 as a pulse-width modulated (PWM) signal that corresponds to the duty cycle signal.

The voltage reading module 128 determines $V_{SUPPLY}$ based on a signal generated by a voltage supply device (not shown). The pressure reading module 130 determines $P_{HYD}$ based on a signal generated by the pressure sensor 58. The duty cycle module 124 determines the variable duty cycle based on $V_{SUPPLY}$ and $P_{HYD}$. More specifically, the duty cycle module 124 includes a duty cycle look-up table. The variable duty cycle is determined from the look-up table based on $V_{SUPPLY}$ and $P_{HYD}$. It is anticipated, however, that the duty cycle module 124 can process $V_{SUPPLY}$ and $P_{HYD}$ using an equation to calculate the variable duty cycle.

The look-up table is generated using specification-based models and simulations. The specification-based models include the following inputs: minimum supply voltage, maximum supply voltage, minimum pressure, maximum pressure and a duty cycle sweep of 100% to 0% for each simulation run. The specification-based models include models for each component of the solenoid driver 120 including the wiring harness 132 and the solenoid 56. System-level simulations are performed to populate the look-up table. For each simulation run, the $V_{SUPPLY}$ and $P_{HYD}$ are fixed and the duty cycle is swept from 100% to 0%. The minimum duty cycle required to hold the solenoid 56 in the second position is determined for the fixed $V_{SUPPLY}$ and $P_{HYD}$. The minimum duty cycle is put into the table and is referenced by the fixed $V_{SUPPLY}$ and $P_{HYD}$ used for that simulation run. Simulation runs are performed for every possible $V_{SUPPLY}$ and $P_{HYD}$ that will occur while the engine 12 is operating in the deactivated mode.

The PWM current signal is provided to the solenoid 56 through a wiring harness 132. A recirculation or free-wheeling diode 134 is included and maintains a continuous flow of current through the solenoid 56. The diode 134 also enables dissipation of the magnetic energy within the solenoid 56 when the current signal is terminated (i.e., switching to the activated mode). In this manner, a voltage spike in the solenoid driver 120 is avoided.

Figure 5:
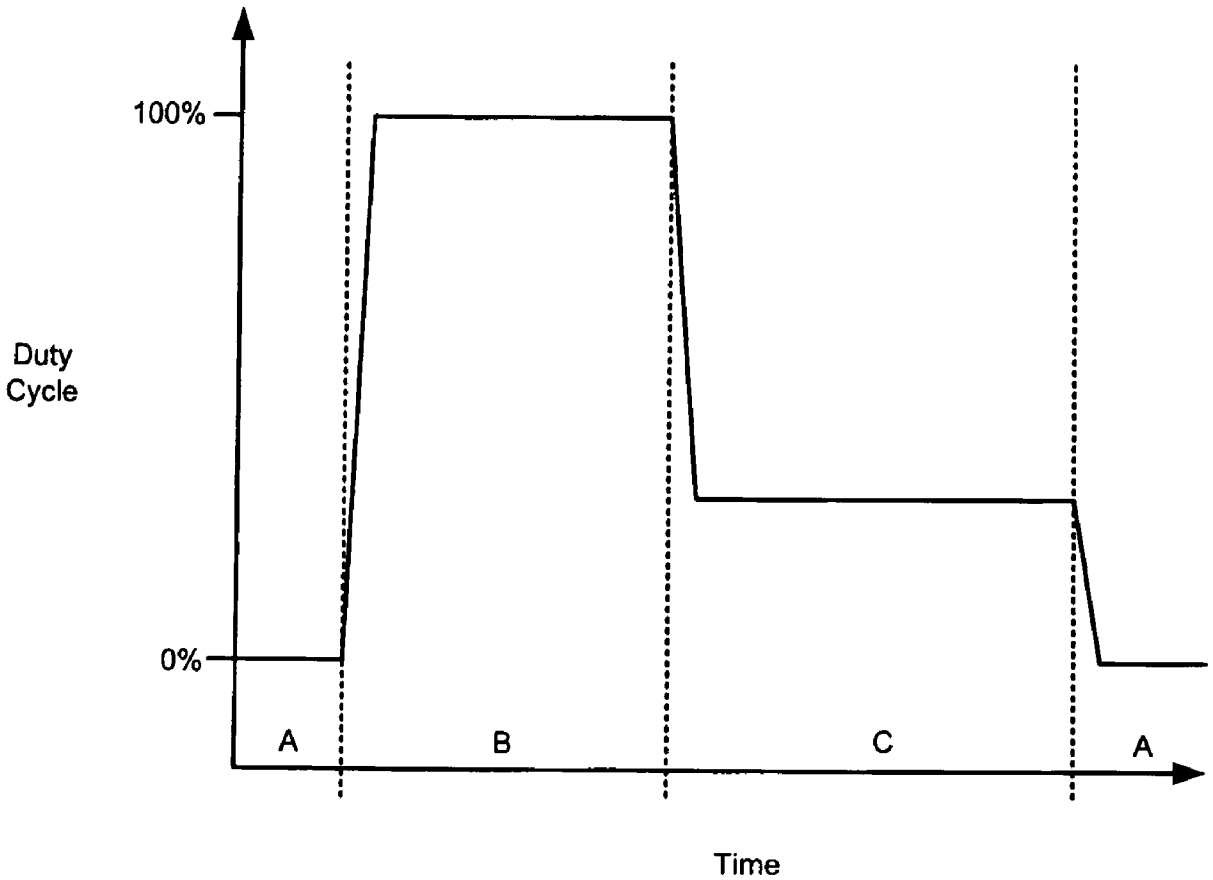
FIG. 5 is a graph illustrating an exemplary duty cycle signal generated according to the solenoid control of the present invention.

Referring now to FIG. 5, an exemplary duty cycle signal is illustrated. During time period A, the engine is operating in the activated mode and the duty cycle signal is at 0%. At the end of time period A, engine operation switches from the activated mode to the deactivated mode and the duty cycle signal ramps up to 100%. Time period B indicates the threshold time allowed for the solenoid plunger to move from the first position to the second position. At the end of time period B, the duty cycle is adjusted to a value greater than 0% and less than 100%, as discussed above. The solenoid is operated at the variable duty cycle over time period C. At the end of time period C, engine operation switches from the deactivated mode to the activated mode and the duty cycle drops to 0%.

The solenoid control of the present invention enables conservation of electrical energy by reducing the current driven through the solenoids. Additionally, the solenoids generate less thermal energy resulting from the self-heating effects of the current flow. This provides a lower solenoid operating temperature, which benefits solenoid reliability and durability. Further, because less heat is generated, a smaller solenoid may be implemented. An additional advantage is realized in that the PWM current signal is more energy efficient than analog amplifiers that are implemented in traditional peak and hold driver circuits. Finally, the solenoid control of the present invention enables the engine to remain in the deactivated mode for a longer time, resulting in further efficiency gains.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A solenoid driver that generates a current signal to drive a solenoid of a lifter oil manifold assembly (LOMA) to switch between activated and deactivated modes in a displacement on demand engine, comprising:

a current module that generates said current signal based on a duty cycle signal; and a switching module that regulates said duty cycle signal based on said activated and deactivated modes, wherein said duty cycle signal is 100% for a first period after said engine switches to said deactivated mode and is variable within a range between greater than 0% and less than 100% for a second period after said first period, while operating in said deactivated mode.

2. The solenoid driver of claim 1 wherein said variable duty cycle is determined based on operating parameters of said LOMA.

3. The solenoid driver of claim 2 wherein said operating parameters include an available voltage and a hydraulic fluid pressure.

4. The solenoid driver of claim 2 wherein said variable duty cycle is determined from a look-up table based on said operating parameters.

5. The solenoid driver of claim 1 further comprising a duty cycle module that generates said variable duty cycle based on an available voltage and a hydraulic fluid pressure associated with said LOMA.

6. The solenoid driver of claim 5 further comprising a voltage module that determines said available voltage based on a voltage signal.

7. The solenoid driver of claim 5 further comprising a pressure module that determines said hydraulic fluid pressure based on a pressure signal.

8. The solenoid driver of claim 5 wherein said duty cycle module includes a look-up table, wherein said variable duty cycle is determined from said look-up table based on said available voltage and said hydraulic fluid pressure.

9. The solenoid driver of claim 1 wherein said duty cycle signal is 0% when said engine is operating in said activated mode.

10. The solenoid driver of claim 1 wherein said current module includes a switch that is regulated based on said duty cycle signal.

11. The solenoid driver of claim 1 wherein said current signal is a pulse-width modulated (PWM) current signal.

12. The solenoid driver of claim 1 further comprising a diode that communicates with an output of said current module, said diode enabling a continuous flow of current through said solenoid.

13. A method of controlling engine operation in activated and deactivated modes in a displacement on demand engine, comprising:

switching engine operation from said activated mode to said deactivated mode;

energizing a solenoid of a lifter oil manifold assembly (LOMA) based on a 100% duty cycle signal for a first period to deactivate a cylinder of said engine; and energizing said solenoid based on a variable duty cycle signal for a second period after said first period, wherein said duty cycle signal varies within a range between greater than 0% and less than 100% while operating in said deactivated mode.

14. The method of claim 13 further comprising: measuring operating parameters of said LOMA; and determining said variable duty cycle signal based on said operating parameters.

15. The method of claim 14 wherein said operating parameters include an available voltage and a hydraulic fluid pressure.

16. The method of claim 14 wherein said variable duty cycle signal is determined from a look-up table based on said operating parameters.

17. The method of claim 13 further comprising: switching said engine operation from said deactivated mode to said activated mode; and de-energizing said solenoid based on a 0% duty cycle signal.

18. The method of claim 13 further comprising generating a pulse-width modulated (PWM) current signal based one of said 100% duty cycle signal and said variable duty cycle signal, wherein said solenoid is energized by said PWM current signal.

19. An engine control system for controlling engine operation in activated and deactivated modes in a displacement on demand engine, comprising:

a lifter oil manifold assembly (LOMA) having a solenoid that is selectively actuated based on a solenoid current to enable operation of a cylinder when said engine is operating in said activated mode and to inhibit operation of said cylinder when said engine is operating in said deactivated mode; and a solenoid driver that regulates a current signal, wherein said solenoid current is at a first level for a first period of operation in said deactivated mode and varies within a range between greater than a minimum value and less than a maximum value for a second period of operation in said deactivated mode.

20. The engine control system of claim 19 wherein said solenoid driver includes a current module that generates said current signal based on a duty cycle signal and a switching module that regulates said duty cycle signal based on said activated and deactivated modes, wherein said duty cycle signal is 100%.

21. The engine control system of claim 19 wherein said current signal is determined based on operating parameters of said LOMA.

22. The engine control system of claim 21 wherein said operating parameters include an available voltage and a hydraulic fluid pressure.

23. The engine control system of claim 20 wherein said solenoid driver further includes a duty cycle module that generates said variable duty cycle based on an available voltage and a hydraulic fluid pressure associated with said LOMA.

24. The engine control system of claim 23 further comprising a voltage module that determines said available voltage based on a voltage signal.

25. The engine control system of claim 23 further comprising a pressure module that determines said hydraulic fluid pressure based on a pressure signal.

26. The engine control system of claim 23 wherein said duty cycle module includes a look-up table, wherein said variable duty cycle is determined from said look-up table based on said available voltage and said hydraulic fluid pressure.

27. The engine control system of claim 20 wherein said duty cycle signal is 0% when said engine is operating in said activated mode.

28. The solenoid driver of claim 20 wherein said current module includes a switch that is regulated based on said duty cycle signal.

29. The solenoid driver of claim 19 wherein said current signal is a pulse-width modulated (PWM) current signal.

30. The engine control system of claim 19 wherein said solenoid driver further includes a diode that enables a continuous flow of current through said solenoid.

* * * * *